US006070702A

United States Patent [19]

Der Kinderen

[11] Patent Number: 6,070,702

[45] Date of Patent: Jun. 6, 2000

[54] PORTABLE STORAGE DEVICE

[75] Inventor: Johannes Martinus Petrus Der Kinderen, Geldermalsen, Netherlands

[73] Assignee: Vandermolen B.V., Nieuwegein, Netherlands

[21] Appl. No.: 09/143,740

[22] Filed: Aug. 31, 1998

[51] Int. Cl.[7] ..... A45C 3/00

[52] U.S. Cl. ..... 190/109; 190/33; 190/35; 190/110; 190/112; 190/113; 190/115

[58] Field of Search ..... 190/109, 110, 190/111, 112, 113, 31, 32, 33, 35, 29, 117, 115

[56] References Cited

U.S. PATENT DOCUMENTS

| | | | |
|---|---|---|---|
| 916,709 | 3/1909 | Hossfeld | 190/35 |
| 953,815 | 4/1910 | Boyd | 190/33 |
| 1,496,662 | 6/1924 | Dyer | 190/33 |
| 2,316,716 | 4/1943 | Ries | 10/112 X |
| 2,585,745 | 2/1952 | Crosby | 190/111 X |
| 3,186,529 | 6/1965 | Gilbert | 190/35 X |
| 3,198,300 | 8/1965 | Tuttle | 190/115 X |
| 5,240,106 | 8/1993 | Plath | 190/113 X |
| 5,431,265 | 7/1995 | Yoo | 190/111 X |

*Primary Examiner*—Stephen P. Garbe
*Assistant Examiner*—Tri M Mai
*Attorney, Agent, or Firm*—Dority & Manning

[57] ABSTRACT

A portable device for the storage of items within a frame with two open ends. The two open ends may be removably closed with covers removably attached to the frame. A first storage device moveable between a first position and a second position is configured to contain items placed therein. The first position is a closed position, wherein the first storage device extends generally completely within the frame. The second position is a open position, wherein the storage device extends at least partially outside the frame. A second storage device is connected to the frame and is slidable between a first position and a second position. In the first position the second storage device extends generally completely within the frame. In the second position, the second storage device extends at least partially outward from the frame. Both first and second storage devices only partially occupy the area defined by the frame of the portable device so that additional items may be placed within the internal storage room without hampering the operation of the first or second storage devices. The second storage device may be completely removed from the portable device.

17 Claims, 2 Drawing Sheets

PORTABLE STORAGE DEVICE

BACKGROUND OF THE INVENTION

The invention relates to a portable storage device for the storage of personal belongings, such as personal care items, jewelry and documents of value.

Portable devices for storage, and more particularly for taking along personal belongings, are already known. The state of the art shows many different so-called vanity cases for personal care items, such as lipstick, eye-shadow, conditioners, shampoo and all other kinds of cosmetic or hygienic items. Furthermore, jewelry boxes are known for storing and taking along small pieces of jewelry. Finally, devices for safe-keeping documents of value, such as credit cards, passports, notes and alike are known.

One major drawback of such known devices is that these devices are meant for only one specific species of items. A so-called vanity case in most instances can only be used for rather small-sized items. The accommodation of larger objects, such as spray cans for hair spray or alike, causes severe problems. Additionally, such beauty cases are not fit to contain jewelry or documents of value. On the other hand, jewelry boxes usually are unfit for containing personal care items or documents of value. Finally, devices meant for the storage of documents of value usually have such reduced dimensions that the storage of other objects, such as personal care items or jewelry, is not possible.

Another drawback of the state-of-the-art devices is that items contained therein typically do not have well-defined positions, but are allowed to wander freely within devices. Therefore, a user of such devices never will be sure where to find an item he or she is looking for.

SUMMARY OF THE INVENTION

It is an object of the present invention to overcome the aforementioned shortcomings associated with the prior art.

Additional objects and advantages of the invention will be set forth in part in the following description, or may be obvious from the description, or may be learned through practice of the invention.

The objects are achieved by providing a portable device for the storage of personal belongings, such as personal care items, jewelry and documents of value. The device has a frame defining its outer shape. A first storage device connects with the frame and is pivotable between a first position, called closed position, in which the first storage device extends completely within the outer shape as defined by the frame, and a second position. A second storage device connects with the frame and is slidable between a first position, called closed position, in which the second storage device extends completely within the outer shape as defined by the frame, and a second position, called open position, in which the second storage device extends at least partially outward from the outer shape as defined by the frame. When in the first position, the first and second storage devices only fill up part of the volume defined within the outer shape of the portable device, such that an internal storage room for large objects is defined in the portable device. The portable device further comprises a carrying device attached to the frame for carrying the portable device.

The frame defines the outer shape of the portable device, such that objects stored within the portable device will be protected against outer influences, such as shocks. The first storage device and second storage device provide storage for moderately dimensioned objects. In the closed position of that first and second storage device, the objects contained therein are safely stored and cannot get lost. In the open position, however, one can gain access to first and second storage devices, such that placing objects into, or removing objects from that storage device may be achieved easily.

The first storage device is pivotable relative to the frame, and cannot be disconnected therefrom. Thus, the first storage device is extremely fit for containing personal care items, such as lipstick, eye-shadow etc.

The second storage device is slidable relative to the frame and, most preferably, is used for jewelry and documents of value.

In the first position, the first and second storage devices only fill up part of the volume defined within the portable device outer shape. As a result, an internal storage room for large objects is defined in the portable device. Within this internal storage room large objects such as spray cans for hair spray or alike can be accommodated.

As a result, the portable device according to the invention is extremely fit for storing different kinds of objects, ranging from personal care items to jewelry and documents of value. All items stored within the storage device have a well-defined position, such that, retrieving an item is easy and can be realized quickly. After an item, such as an item for personal care, has been taken out from the device, the portable device can be used as a dressing-table, especially if the storage device, as stated later, comprises a mirror.

Because of the provision of a carrying device, a user of the portable device may carry along the portable device in a comfortable manner.

In a preferred embodiment, the second storage device is fully detachable and removable from the frame and has such dimensions as to offer the possibility of storage in a safe-deposit box. When a user of the portable storage device stays at a hotel, he only needs to remove the second storage device from the portable device and put it in a safe-deposit box. The items of value (jewelry or documents of value) do not need to be removed from the second storage device.

In such a case, it is further preferred that the second storage device is shaped as a box with a bottom, circumferential walls and a top. The top is hingeably connected to the circumferential walls so as to define a cover movable between a first position preventing free access and a second position offering free access to the inside of the box. The top of the second storage device protects the contents of the second storage device and keeps these contents hidden. This is a distinct advantage when the user has to take the second storage device from his room to the reception area of a hotel where a safe-deposit box may be presented.

In another embodiment, the first storage device is provided with pivots cooperating with sockets in the frame. The pivots are attached to the first storage device near the lower side thereof. The first storage device, at a position remote from the pivots, near the upper side of the first storage device, is provided with a mirror hingeably connected to the first storage device. The mirror is spring loaded towards a position extending substantially vertically outward from the first storage device. The mirror is positioned so that, when the first storage device is moved from the opened position towards the closed position, the mirror cooperates with the frame to move from the substantially vertical extended position towards a substantially horizontal position, wherein the mirror defines a cover for the first storage device. When the first storage device is moved from the first closed position towards the second open position, the spring loaded mirror is released by the frame and automatically moves towards a position extending substantially vertically outward from the first storage device. In that vertically extended position, a user can use the mirror, for example, for applying make-up or alike. When the first storage device is pushed back (pivoted back) inside the storage device, the mirror contacts the frame and moves towards the substantially horizontal position.

According to a further preferred embodiment, the portable storage device comprises a top frame, to which the carrying device is connected, and a bottom frame, positioned opposite from the top frame, wherein the internal storage room for large objects extends from the bottom frame towards the top frame. Basically, a large internal storage room is obtained when the first storage device and second storage device are positioned at the same side of the portable device.

In yet another embodiment, the portable device comprises a side cover which is releasably connected to the frame. The side cover, when fully connected to the frame, denies access to the first and second storage devices and to the internal storage room. When the cover is at least partially disconnected from the frame, or at least partially removed, it makes at least one of the first and second storage devices and internal storage room accessible for use.

In still another embodiment, the portable device comprises a top frame, a bottom frame positioned oppositely to the top frame, and two oppositely positioned side frames connecting the top and bottom frames. Each of the top, bottom and side frames comprise two opposite edges, which are connected to the respective edges of adjoining top, bottom or side frames, and two free opposite edges. The free opposite edges of the top and side frames are provided with a device for defining a releasable connection with corresponding edges of the side covers, while the free opposite edges of the bottom frame are hingeably, but not releasably, connected with the side covers.

Finally, an embodiment of the portable storage device is mentioned in which the side covers are double-walled for providing, between the two walls, a storage space for objects having a large area. The storage space for objects having a large area may be used for clothes or the like.

BRIEF DESCRIPTION OF THE DRAWINGS

The invention will be more readily understood and the further objects and advantages thereof will be more apparent when read in conjunction with the accompanying drawings showing preferred embodiments of the invention. In the drawings.

DETAILED DESCRIPTION

Figure 2:
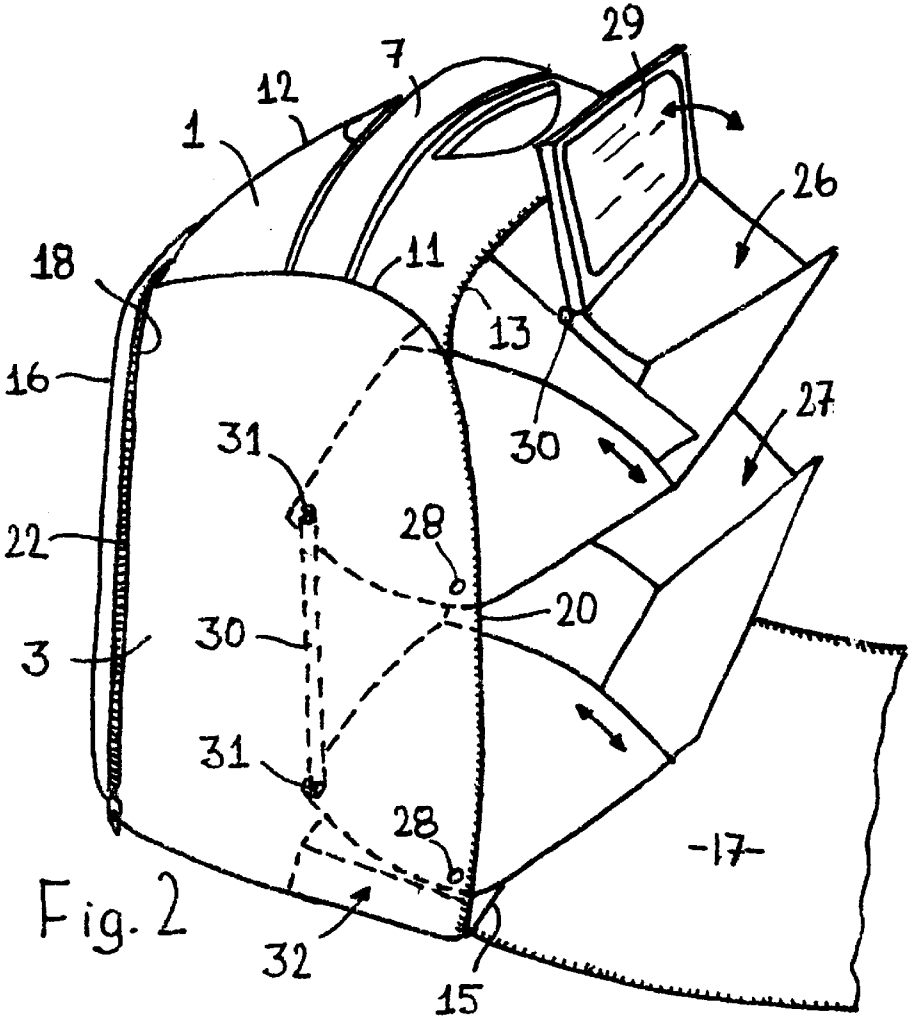
FIG. 2 is a perspective view of the device of FIG. 1 in a second position.

Reference will now be made to the presently preferred embodiments of the invention, one or more examples which are illustrated in the drawings. Each example is provided by way of explanation of the invention, and not meant as a limitation of the invention. For example, features illustrated or described as part of one embodiment can be used on another embodiment. Such modifications and variations are within the scope and spirit of the invention.

Figure 4:
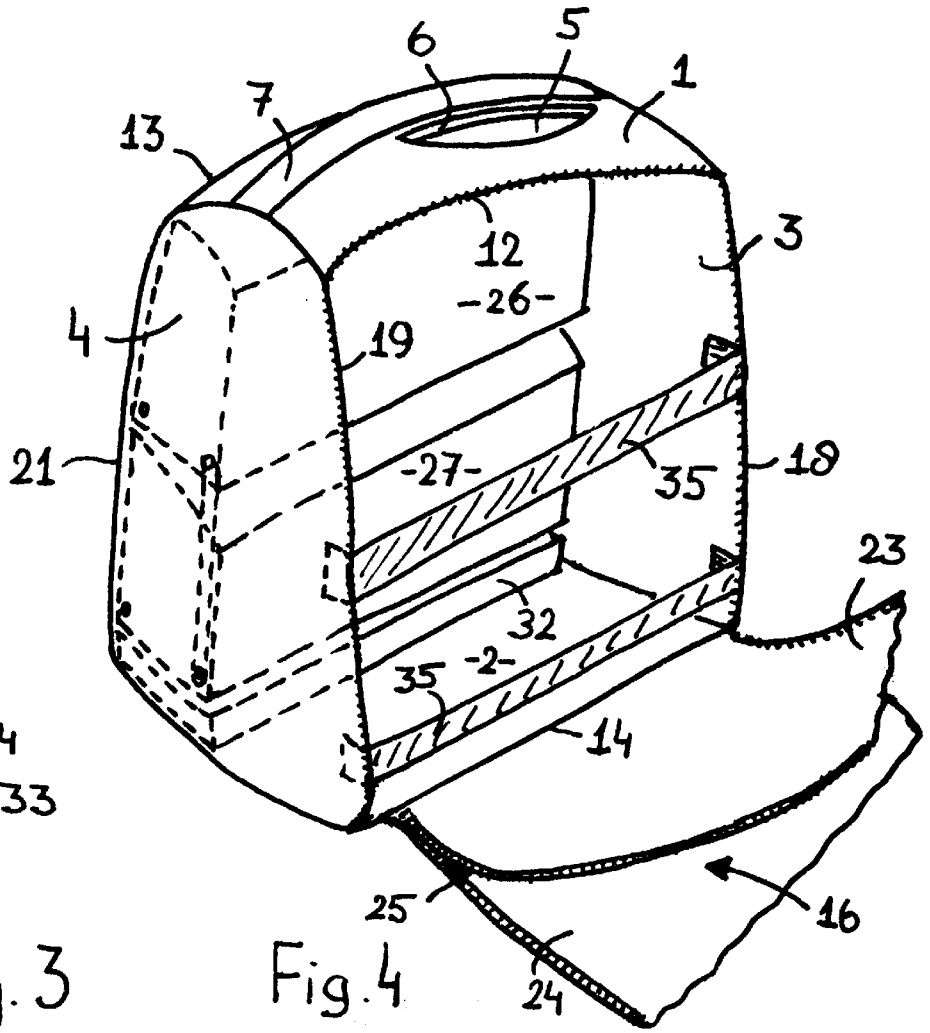
FIG. 4 is a perspective view of the device of FIG. 1 in a fourth position.
Figure 3:
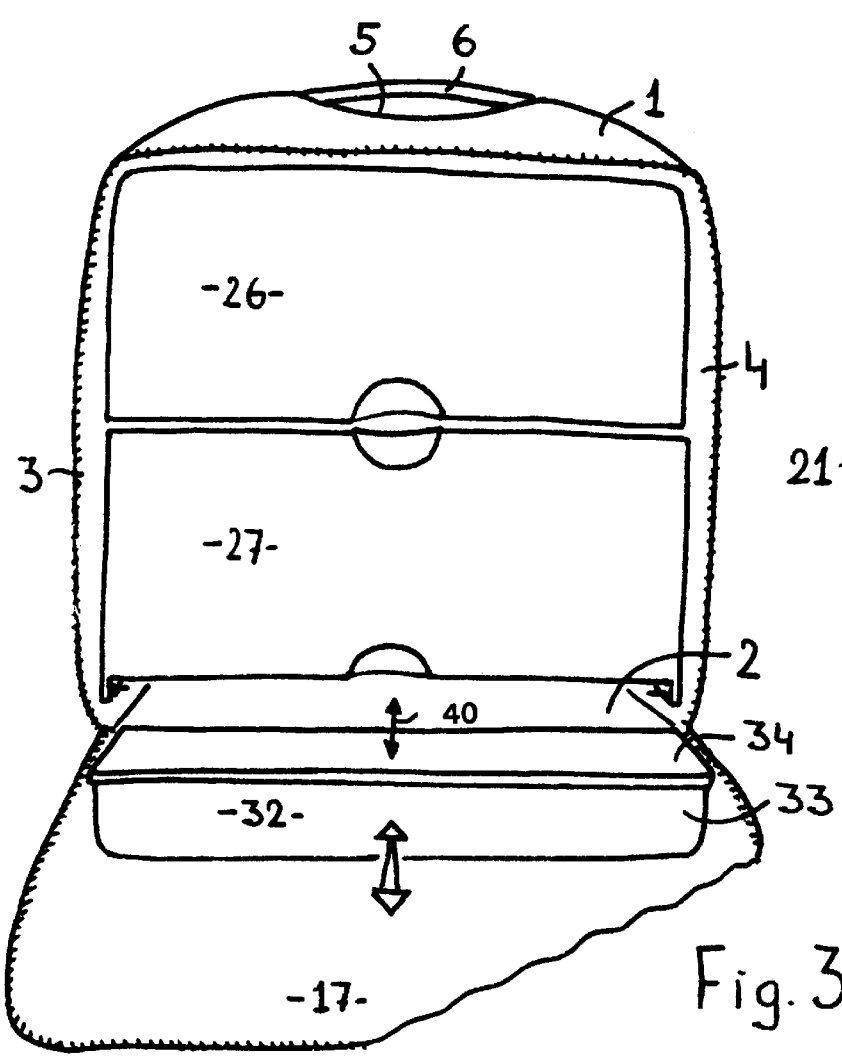
FIG. 3 is a perspective view of the device of FIG. 1 in a third position.

A preferred embodiment of the portable storage device according to the invention will now be described while referring to the drawings. As shown in FIG. 3 and FIG. 4 the portable device comprises a frame consisting of a top frame 1, bottom frame 2 and two oppositely positioned side frames 3, 4, connecting the top frame 1 and bottom frame 2.

In the top frame 1, there is provided a recess 5 bridged by a handle 6 which defines a carrying device for the portable device.

Further, flexible strap 7 is attached to the frame, most preferably to the side frames 3 and 4. At least one end of the flexible strap 7 cooperates with an automatically operating strap tensioning mechanism 8 (only schematically indicated in FIG. 1) attached internally to the frame. The strap tensioning mechanism keeps the flexible strap taut against the frame when the flexible strap is not in use.

Figure 1:
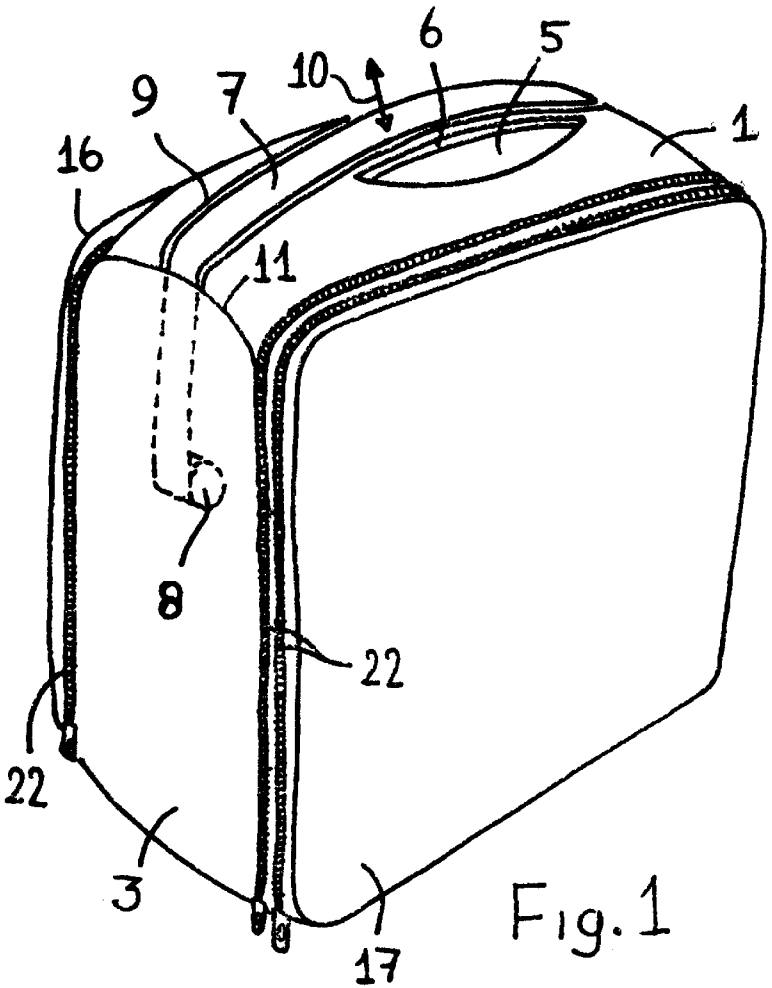
FIG. 1 is a perspective view of an embodiment of a portable device according to the invention in a first position.

In FIG. 1, top frame 1 is provided with a shallow recess 9 for accommodating the strap 7 when it is taut against the frame, especially the top frame 1. This shallow recess 9 also extends along the handle 6.

While the flexible strap 7 runs outwardly of the top frame 1, it runs inwardly of the side frames 3 and 4 (as indicated by dotted lines in FIG. 1). However, it would also be possible that the flexible strap 7 runs outwardly of the side frame 3 and 4, but is hidden by a protective cover extending parallel to the side frames 3 and 4, and being attached thereto, in such a way, that a small space is provided therebetween for accommodating the strap 7.

In the illustrated embodiment of the portable device, a user may choose either to carry it by the handle 6 (by gripping it manually) or by the flexible strap 7 (by supporting it with a shoulder). In the latter case, the strap tensioning mechanism 8 will unroll the flexible strap 7 correspondingly. When released, the flexible strap 7 will be rolled up again by the strap tensioning mechanism 8.

Extension of the flexible strap 7 has been indicated in FIG. 1 by arrow 10.

The portable device has a top frame 1, a bottom frame 2 positioned oppositely to the top frame, and two oppositely positioned side frames 3, 4, which connect the top and bottom frames. Each of the top, bottom and side frames comprises two opposite edges connected to respective edges of adjoining top, bottom and side frames. A junction between adjoining edges has been indicated with 11 in FIGS. 1 and 2. At this junction 11, an edge of the top frame 1 meets a corresponding edge of the side frame 3. It is conceivable that the top frame 1 and side frame 3 are molded integrally at the junction 11, as well as all adjoining frame junctions which are not described in detail herein. However, it is also possible that the top frame 1, bottom frame 2 and side frames 3 and 4 are constructed separately and are connected to each other in any appropriate manner.

Apart from the edges meeting each other at the junctions 11, each of the top frame 1, bottom frame 2 and side frames 3 and 4 comprises two free opposite edges, for example, edges 12 and 13 of top frame 1. Connected to the free edges of the bottom frame 2, wherein FIG. 4 free edge 14 is visible and in FIG. 2, free edge 15 is visible, are covers 16 and 17. In the illustrated embodiment, covers 16 and 17 are constructed of flexible material, such as nylon or leather. Due to the flexible nature of these covers 16 and 17, no special hinging arrangement is necessary at the free edges 14 and 15 to allow the covers to be moved from an open position (illustrated in FIGS. 2 and 4) into a closed position (such as shown in FIG. 1).

The opposite free edges 12 and 13 of the top frame 1, the opposite free edges 18 and 20 of the first side frame 3, and the opposite free edges 19 and 21 of the second side frame 4 are provided with means for realizing a releasable connection with corresponding edges of the side cover means 16 and 17. For example, the means for realizing a releasable connection may comprise zippers 22, as indicated schematically in FIG. 1.

As shown in FIG. 4, side cover 16 is double-walled, comprising sheets 23 and 24, between which a storage space for objects having a large area, such as clothes, is defined. The sheets 23 and 24 may be connected to each other in a releasable manner by a zipper 25, for example.

It is conceivable that the side covers 16 and 17 are made of a rigid material. In order to provide for a hinging motion between the open position according to FIGS. 2 and 4 and the closed position according to FIG. 1, an appropriate hinge should be provided at the free edges 14 and 15 of the bottom frame 2.

When fully connected to the frame, the side covers deny access to the internal space of the portable device. When the side frames 16 and 17 are at least partially disconnected from the frame (e.g. by unzipping the zippers), the internal space of the storage device becomes accessible for use. This will be discussed below.

Within the portable storage device, first storage devices 26 and 27 are provided. The first storage device 26 and 27 comprise pivots 28 cooperating with sockets (not illustrated) in the side frames 3 and 4. As a result, the first storage devices are connected with the side frame 3 and 4 as to be pivotable between a first position, called closed position (shown in FIG. 3), in which the first storage devices 26 and 27 extend completely within the outer shape of the portable device as defined by the frame, and a second position, called opened position (illustrated in FIG. 2), in which the first storage devices have been pivoted outward around the pivots 28 and extend at least partially outside of the outer shape as defined by the frame. In this opened position, the first storage devices 26 and 27 are accessible for receiving objects or for removing objects therefrom.

As appears clearly in FIG. 2, the pivots 28 are attached to the first storage devices 26 and 27 near the lower side thereof. At a position remote from the pivots, near the upper side of at least one of the first storage devices 26 or 27, a mirror 29 is hingeably (41) connected to the first storage device 26. In a manner not illustrated in detail, the mirror 29 is spring loaded towards a position (shown in FIG. 2) extending substantially vertically outward from the first storage device 26, and will thus move to the shown extended position upon the storage device being moved to the open position. The mirror 29 is positioned such that, when the first storage device 26 is moved from the opened position shown in FIG. 2 towards the closed position shown in FIG. 3, the mirror 29 cooperates with top frame 1 to automatically move from the substantially vertical extended position (FIG. 2) towards a substantially horizontal position, wherein mirror 29 defines a cover for the first storage device 26.

When, according to the illustrated embodiment, the portable device comprises multiple first storage devices 26 and 27, positioned one above the other, a connecting device is provided. Connecting device connects the multiple storage devices 26 and 27 to each other in such a manner that when operating one of the multiple first storage devices, all first storage devices will be operated. In the specific embodiment illustrated, the connecting device comprises connecting rods 30. The respective ends of the connecting rods 30 are connected to adjoining storage devices 26 and 27 of the portable device. Needless to say, the connection between the respective ends of the rods 30 and the first storage devices 26 and 27 comprises pivots 31.

The first storage devices 26 and 27 are extremely fit for the storage of personal care items, such as lipstick, eyeshadow and other make-up items.

Additionally, a second storage device 32 is provided which is shaped as a box having a bottom (not visible), circumferential walls 33 and top 34. The top 34, not shown in detail, is hingeably connected to one of the circumferential walls 33 to define a cover movable between a first position preventing free access (illustrated in FIG. 3) and a second position offering free access to the inside of the box (this movement has been indicated schematically by arrow 40 in FIG. 3).

In the illustrated embodiment of the portable device, the second storage device 32 is slidable between a first position, wherein second storage device 32 extends completely within the outer shape as defined by the frame, and a second position, wherein second storage device 32 extends at least partially outwardly of the outer shape. Specifically, the box-like second storage device 32 is fully detachable and removable from the frame as illustrated in FIG. 3. In such a case, it is preferred that the second storage device 32 has such dimensions as to offer the possibility of storage thereof in a safe-deposit box.

The second storage device 32 is most appropriate for the storage of jewelry and documents of value. In a hotel, its user can easily remove the box-like second storage device 32 from the portable device and put it in a safe-deposit box.

When both the first storage devices 26 and 27 and second storage device 32 are in the first, closed position (such as indicated in FIG. 4), they only fill up part of the volume (or internal space) within the portable device. As a result, a large internal storage room or additional storage space for large objects is defined in the portable device as shown in FIG. 4. The large internal storage room may be used for the storage of larger objects, such as spray cans, bottles or the like. Because, in the illustrated embodiment, the first storage devices 26 and 27 and second storage device 32 are positioned one above the other on the same side of the portable storage device, the large internal storage room extends from top frame 1 to bottom frame 2.

Further, FIG. 4 shows straps 35 interconnecting the oppositely positioned side frames 3 and 4. These straps 35 may be constructed of flexible material. The straps 35 prevent large objects from falling out of the portable device when the cover 16 has been moved towards the open position shown in FIG. 4.

The ends of the strap 35, cooperating with the respective side frames 3 and 4, may be provided with protrusions (not illustrated) cooperating with recesses (not shown either) provided in the side frames 3 and 4, so that the position of the strap within the portable device is adjustable (e.g. adjustable in height). Additionally, locks may be provided to prevent an unauthorized access to the contents of the portable device.

While the invention has been illustrated and described with reference to specific embodiments thereof, it will be understood that other embodiments may be envisaged within the scope of the following claims.

It should be appreciated by those skilled in the art that various modifications and variations can be made in the present invention without departing from the spirit and scope of the invention. It is intended that the present invention include such modifications and variations as come within the scope of the claims and their equivalents.

What is claimed is:

1. A portable device for storing or packing objects, comprising:

a frame forming an internal storage room between two open ends on opposite sides;

side covers to close said open ends; and at least one storage device connected to said frame which is movable between a first position and a second position, wherein said first position is a closed position where said storage device extends substantially entirely through a first said open end into said internal storage room and said second position is an open position where said storage device has moved partially out of said first open end so that said storage device is accessible from the outside; and wherein said internal storage room within said frame, when said storage device in said closed position, is accessible from a second said open end opposite said first open end and further comprises additional storage space defined between said storage device and said second open end so that objects may be placed inside said internal storage room into said additional storage space from said second open end and stored adjacent said storage device, wherein said storage devices comprises a compartment.

2. A portable device for storing or packing objects according to claim 1, wherein said storage device is pivotally connected to said frame.

3. A portable device for storing or packing objects according to claim 1, wherein said storage device is slidably attached to said frame.

4. A portable device for storing or packing objects according to claim 3, wherein said storage device is removable from said frame.

5. A portable device for storing or packing objects according to claim 1, further comprising straps connected to said frame near said second open end to prevent objects from falling out of said additional storage space.

6. A portable device for storing or packing objects according to claim 1, wherein said side covers comprises two parts, where each part covers one said open end.

7. A portable device for storing or packing objects according to claim 1, wherein said side cover is double-walled.

8. A portable device for storing or packing objects according to claim 1, wherein said frame further comprises frame parts that are integrally formed.

9. A portable device for storing or packing objects according to claim 1, wherein said frame further comprises frame parts that are jointed to form said frame.

10. A portable device for storing or packing objects, comprising:

a frame forming an internal storage room with two open ends on opposite sides;

side covers to close said open ends; and at least two types of storage devices connected to said frame and movable between a first position and a second position, wherein said first position is a closed position where the storage devices extend substantially entirely through a first open end into said internal storage room and said second position is an open position where the storage device has moved partially out of said first open end so that said storage device is accessible from the outside, said storage devices further comprise a first said storage device pivotally connected to said frame, and a second said storage device slidably attached to said frame;

wherein said internal storage room within said frame, when said storage devices are in a closed position, further comprises additional storage space within said frame adjacent said storage devices which is accessible from a second open end so that objects may be placed within said additional storage space from said second open end and stored adjacent said storage devices when said storage devices are in said first position, wherein at least one of said storage devices comprises a compartment.

11. A portable device for storing or packing objects according to claim 10, wherein at least one of said first and second storage devices have at least a partially removable cover.

12. A portable device for storing or packing objects according to claim 11, wherein said at least one cover has a mirror attached.

13. A portable device for storing or packing objects according to claim 12, wherein said cover with said mirror automatically opens to display said mirror and covers said storage device when said storage device is moved into said closed position.

14. A portable device for storing or packing objects, comprising:

a frame forming an internal storage room with two open ends on opposite sides;

covers to close said open ends; and at least two types of storage devices connected to said frame and movable between a first position and a second position, wherein said first position is a closed position where the storage devices extend substantially entirely through a first open end into said internal storage room and said second position is an open position where said storage devices have moved partially through said first open end so that said storage devices are accessible from the outside, wherein said storage devices further comprise at least two first types of storage devices pivotally connected to said frame and each other so that when one first storage device is moved between said first and second positions, all said first storage devices move between said first and second positions, and a second type of storage device slidably attached to said frame;

wherein said internal storage room within said frame, when said storage devices are in a closed position, further comprises additional storage space within said frame adjacent said storage devices which is accessible from a second open end so that objects may be placed inside said internal storage room from said second open end and stored adjacent said storage devices when said storage devices are in said first position, wherein at least one of said storage devices comprises a compartment.

15. A portable device for storing or packing objects according to claim 14, wherein a carrying handle is formed in said portable device.

16. A portable device for storing or packing objects according to claim 14, wherein a retractable strap is attached to said portable device.

17. A portable device for storing or packing objects according to claim 16, wherein said strap is retractable into a recess formed into said portable device.

* * * * *